US010916170B2

(12) United States Patent
Li et al.

(10) Patent No.: US 10,916,170 B2
(45) Date of Patent: Feb. 9, 2021

(54) GATE DRIVING CIRCUIT FOR DETECTING SCANNING SIGNAL ABNORMALITIES AND DRIVING METHOD THEREOF

(71) Applicants: Hefei Xinsheng Optoelectronics Technology Co., Ltd., Anhui (CN); BOE Technology Group Co., Ltd., Beijing (CN)

(72) Inventors: Meng Li, Beijing (CN); Yongqian Li, Beijing (CN); Zhidong Yuan, Beijing (CN); Can Yuan, Beijing (CN)

(73) Assignees: HEFEI XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/443,325

(22) Filed: Jun. 17, 2019

(65) Prior Publication Data

US 2020/0090571 A1 Mar. 19, 2020

(30) Foreign Application Priority Data

Sep. 14, 2018 (CN) ..... 2018 1 1076098

(51) Int. Cl.
*G09G 3/20* (2006.01)

(52) U.S. Cl.
CPC ..... *G09G 3/20* (2013.01); *G09G 2310/0264* (2013.01)

(58) Field of Classification Search
CPC ..... G09G 3/20
USPC ..... 345/204
See application file for complete search history.

(56) References Cited

U.S. PATENT DOCUMENTS

| | | | | |
|---|---|---|---|---|
| 2006/0050027 | A1* | 3/2006 | Meguro | G09G 3/22 345/75.2 |
| 2017/0278441 | A1* | 9/2017 | Ooki | G09G 3/3648 |
| 2020/0020293 | A1* | 1/2020 | Zhang | G09G 3/006 |
| 2020/0035177 | A1* | 1/2020 | Kawachi | G09G 3/3677 |

* cited by examiner

*Primary Examiner* — Long D Pham
(74) *Attorney, Agent, or Firm* — Nath, Goldberg & Meyer; Joshua B. Goldberg

(57) ABSTRACT

The present disclosure provides a gate driving circuit and a driving method thereof as well as a display device. The gate driving circuit comprises a driving circuit connected to a gate line for outputting a gate scanning signal; and a detecting circuit connected to the gate line for collecting and recording the gate scanning signal.

18 Claims, 6 Drawing Sheets

GATE DRIVING CIRCUIT FOR DETECTING SCANNING SIGNAL ABNORMALITIES AND DRIVING METHOD THEREOF

CROSS-REFERENCE TO RELATED APPLICATION

This application claims the priority of Chinese Patent Application No. 201811076098.3, filed on Sep. 14, 2018, the contents of which are herein incorporated by reference in their entirety.

TECHNICAL FIELD

The present disclosure relates to the display technology, more particularly, to a gate driving circuit and a driving method thereof, a display device.

BACKGROUND

At present, in order to reduce manufacturing cost of a display device and to realize a narrow frame of the display device, GOA (Gate Driver On Array) technology is increasingly used in manufacturing process of the display device, and corresponding gate scanning signals are output through a GOA circuit. It directly affects the display of the display device that the gate scanning signals of all levels are normal or not. If there is a problem of the signal output by a certain level GOA, it may cause display abnormality.

As all GOA circuits are integrated inside a panel, a waveform of the gate scanning signal on each gate line cannot be obtained from outside, which is disadvantageous for later analysis of problems of the product. Therefore, it is necessary to detect the gate scanning signals.

SUMMARY

The present disclosure provides a gate driving circuit including a driving circuit connected to a plurality of gate lines and configured to output gate scanning signals; and a detecting circuit connected to the gate lines and configured collect and record the gate scanning signals.

According to an embodiment of the present disclosure, the detecting circuit includes a collecting sub-circuit and a recording sub-circuit. The collecting sub-circuit is connected to the gate lines and the recording sub-circuit and configured to transmit the gate scanning signals collected from the gate lines to the recording sub-circuit, and the recording sub-circuit is configured to record the gate scanning signal.

According to an embodiment of the present disclosure, the collecting sub-circuit includes a first switch transistor and a plurality of third switch transistors, each of the plurality of third switch transistors is connected to a corresponding one of the gate lines. A gate electrode of the first switch transistor is connected to an enable signal end, a first electrode of the first switch transistor is connected to a first control signal end, and a second electrode of the first switch transistor is connected to gate electrodes of the plurality of third switch transistors. Each of first electrodes of the plurality of third switch transistors is connected to a corresponding one of the gate lines, and second electrodes of the plurality of third switch transistors are connected to the recording sub-circuit.

According to an embodiment of the present disclosure, the collecting sub-circuit further includes a second switch transistor. The gate electrode of the first switch transistor and a gate electrode of the second switch transistor are connected to the enable signal end. The first electrode of the first switch transistor is connected to the first control signal end, and the second electrode of the first switch transistor is connected to gate electrodes of a part of the plurality of third switch transistors. A first electrode of the second switch transistor is connected to a second control signal end, and a second electrode of the second switch transistor is connected to gate electrodes of a remaining part of the plurality of third switch transistors. The gate lines corresponding to the third switch transistors connected to the first switch transistor and the gate lines corresponding to the third switch transistors connected to the second switch transistor are alternately arranged with each other.

According to an embodiment of the present disclosure, the collecting sub-circuit further include a plurality of diodes, and each of the plurality of third switch transistors is connected to a corresponding one of the plurality of diodes. The plurality of diodes are connected in series, each of the second electrodes of the plurality of third switch transistors is connected to an anode of the corresponding one of the plurality of diodes, and a cathode of the last one of the plurality of diodes connected in series is connected to the recording sub-circuit.

According to an embodiment of the present disclosure, the recording sub-circuit includes an analog-to-digital conversion circuit and/or a counting circuit connected to the cathode of the last one of the plurality of diodes connected in series. The analog-to-digital conversion circuit is configured to convert the gate scanning signal into a digital signal, and the counting circuit is configured to count the number of pulses of the gate scanning signals.

According to an embodiment of the present disclosure, the driving circuit includes a plurality of gate driving circuit units connected to the gate lines, respectively.

According to an embodiment of the present disclosure, the gate driving circuit includes a first group of the driving circuit and the detecting circuit disposed at and connected to a first end of the gate lines.

According to an embodiment of the present disclosure, the gate driving circuit further includes a second group of the driving circuit and the detecting circuit disposed at and connected to a second end of the gate lines.

The present disclosure also provides a display device including the gate driving circuit described herein.

The present disclosure also provides a driving method of a gate driving circuit including a driving circuit and a detecting circuit, the method includes: outputting, by the driving circuit, gate scanning signals to a plurality of gate lines; and collecting and recording, by the detecting circuit, the gate scanning signals on the gate lines.

According to an embodiment of the present disclosure, the detecting circuit of the gate driving circuit includes a collecting sub-circuit and a recording sub-circuit, the collecting sub-circuit is connected to the gate lines and the recording sub-circuit and includes a first switch transistor and a plurality of third switch transistors. Each of the plurality of third switch transistors is connected to a corresponding one of the gate lines. A gate electrode of the first switch transistor is connected to an enable signal end, a first electrode of the first switch transistor is connected to a first control signal end, and a second electrode of the first switch transistor is connected to gate electrodes of the plurality of third switch transistors. Each of first electrodes of the plurality of third switch transistors is connected to a corresponding one of the gate lines, and second electrodes of the plurality of third switch transistors are connected to the recording sub-circuit. The driving method further includes: turning on, by an enable signal, the first switch transistor; turning on, by a first control signal, the third switch transistors connected to the first switch transistor; and transmitting, by the third switch transistors connected to the gate lines, gate scanning signals on the gate lines to the recording sub-circuit.

According to an embodiment of the present disclosure, the collecting sub-circuit further includes a second switch transistor. The gate electrode of the first switch transistor and a gate electrode of the second switch transistor are connected to the enable signal end. The first electrode of the first switch transistor is connected to the first control signal end, and the second electrode of the first switch transistor is connected to gate electrodes of a part of the plurality of third switch transistors. A first electrode of the second switch transistor is connected to a second control signal end, and a second electrode of the second switch transistor is connected to gate electrodes of a remaining part of the plurality of third switch transistors. The gate lines corresponding to the third switch transistors connected to the first switch transistor and the gate lines corresponding to the third switch transistors connected to the second switch transistor are alternately arranged with each other. The driving method further includes: turning on, by the enable signal, the first switch transistor and/or the second switch transistor; turning on, by the first control signal, the third switch transistors connected to the first switch transistor; turning on, by the second control signal, the third switch transistors connected to the second switch transistor; and transmitting, by the third switch transistors connected to the gate lines, the gate scanning signals on the gate lines to the recording sub-circuit.

According to an embodiment of the present disclosure, the gate driving circuit includes a first group of the driving circuit and the detecting circuit disposed at and connected to a first end of the gate lines, and the driving method further includes: driving, by the driving circuit of the first group, the gate lines at the first end; and collecting and recording, by the detecting circuit of the first group, the gate scanning signals at the first end of the gate lines.

According to an embodiment of the present disclosure, the gate driving circuit further includes a second group of the driving circuit and the detecting circuit disposed at and connected to a second end of the gate lines, and the driving method further includes: driving, by the driving circuits of the first and second groups, the gate lines at the first and second ends; and collecting and recording, by the detecting circuits of the first and second groups, the gate scanning signals at the first and second ends of the gate lines, respectively.

According to an embodiment of the present disclosure, the gate scanning signals at the first and second ends of the gate lines are collected and recorded simultaneously or sequentially by the detecting circuits of the first and second groups.

According to an embodiment of the present disclosure, the gate scanning signals on two adjacent gate lines are output successively, the first control signal is halted before the gate scanning signals collected under a control of the first control signal are halted, and the second control signal is halted before the gate scanning signals collected under a control of the second control signal are halted.

According to an embodiment of the present disclosure, the gate scanning signals on two adjacent gate lines are output partially overlapped, and the first control signal and the second control signal are halted before the gate scanning signals collected respectively under controls of the first control signal and the second control signal are overlapped with each other.

According to an embodiment of the present disclosure, the gate scanning signals on two adjacent gate lines are output successively, and the first control signal is halted before the gate scanning signals collected under a control of the first control signal are halted.

According to an embodiment of the present disclosure, the gate scanning signals on two adjacent gate lines are output partially overlapped, and the first control signal is halted before the gate scanning signals collected under a control of the first control signal are overlapped with each other.

BRIEF DESCRIPTION OF THE FIGURES

The following drawings are merely examples for illustrative purposes according to various disclosed embodiments and are not intended to limit the scope of the present disclosure. In the drawings.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

Figure 1:
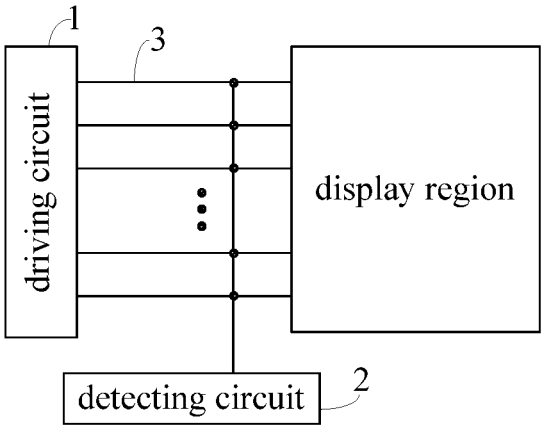
FIG. 1 is a principle block diagram illustrating a gate driving circuit according to some embodiments of the present disclosure.

FIG. 1 is a principle block diagram illustrating a gate driving circuit according to some embodiments of the present disclosure.

Referring to FIG. 1, in some embodiments, the gate driving circuit includes: a driving circuit 1 connected to gate lines 3 to output gate scanning signals; and a detecting circuit 2 connected to the gate lines 3 to collect and record the gate scanning signals for abnormal diagnosis of the gate scanning signals.

By setting the detecting circuit, the gate driving circuit according to the embodiment may be capable of collecting and recording the gate scanning signals in real time, so as to detect the gate scanning signals in real time and to determine whether the gate scanning signals are abnormal based on the detection result quickly. Further, it is able to quickly determine the position where the gate scanning signals abnormally appears to promptly eliminate the fault.

Figure 2:
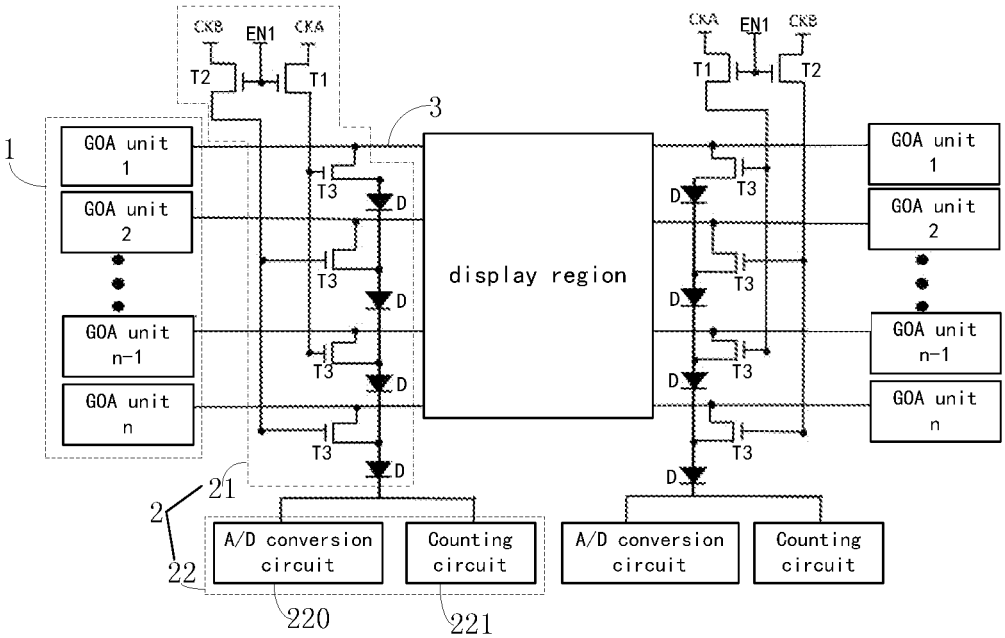
FIG. 2 is a schematic structure diagram illustrating a gate driving circuit according to some embodiments of the present disclosure.

FIG. 2 is a schematic structure diagram illustrating a gate driving circuit according to some embodiments of the present disclosure. Referring to FIG. 2, in some embodiments, the gate driving circuit includes: a driving circuit 1 connected to n gate lines 3 (n is an integer greater than 1) to output a gate scanning signals; and a detecting circuit 2 connected to the n gate lines 3 to collect and record the gate scanning signals for abnormal diagnosis of the gate scanning signals.

In some embodiments, the detecting circuit 2 may include a collecting sub-circuit 21 and a recording sub-circuit 22. The collecting sub-circuit 21 is connected to the gate lines 3 and the recording sub-circuit 22 to transmit the gate scanning signals collected from the gate lines 3 to the recording sub-circuit 22, and the recording sub-circuit 22 is used to record the gate scanning signals. The collecting sub-circuit 21 can perform real-time collection of the gate scanning signals on the gate lines 3, and the recording sub-circuit 22 can record the gate scanning signals collected in real time.

In some embodiments, the collecting sub-circuit 21 may include a first switch transistor T1, a second switch transistor T2, and a plurality of third switch transistors T3. Each of the plurality of third switch transistors T3 is connected to a corresponding one of the gate lines 3. A gate electrode of the first switch transistor T1 and a gate electrode of the second switch transistor T2 are connected to an enable signal end EN1. A first electrode of the first switch transistor T1 is connected to a first control signal end CKA, and a second electrode of the first switch transistor T1 is connected to gate electrodes of a part of the third switch transistors T3. A first electrode of the second switch transistor T2 is connected to a second control signal end CKB, and a second electrode of the second switch transistor T2 is connected to gate electrodes of a remaining part of the third switch transistors T3 (i.e., which is/are not connected to the first switch transistor T1). The gate lines 3 corresponding to the third switch transistors T3 connected to the first switch transistor T1 and the gate lines 3 corresponding to the third switch transistors T3 connected to the second switch transistor T2 are alternately arranged with each other.

In a gate driving process, the gate lines 3 are sequentially scanned one by one according to a setting order, so that the first control signal end CKA and the second control signal end CKB can control the third switch transistors T3 to collect the gate scanning signals on the alternately arranged gate lines 3, respectively, so as to avoid interference and influence of the gate scanning signals collected from adjacent two gate lines of the gate lines 3 in a signal collecting process. Each of first electrodes of the third switch transistors T3 is connected to a corresponding one of the gate lines 3, and second electrodes of all of the third switch transistors T3 are electrically connected to the recording sub-circuit 22.

In some embodiments, the collecting sub-circuit 21 may further include a plurality of diodes D connected in series. Each of the third switch transistors T3 is connected to a corresponding one of the diodes D. Each of the second electrodes of the third switch transistors T3 is connected to an anode of the corresponding one of the diodes D, and a cathode of the last one of the diodes D connected in series is connected to the recording sub-circuit 22. By connecting the plurality of diodes D in series, on the one hand, it is possible to prevent the gate scanning signal collected from the currently driven k-th gate line 3 from being transmitted to previous k−1 gate lines 3 in front of the k-th gate line 3 through a part of the turned-on third switch transistors T3 connected to the previous k−1 gate lines 3 ($1<k<=n$, and k is an integer), so as to avoid affecting the output effect of the gate scanning signals; on the other hand, the second electrodes of all the third switch transistors T3 are connected to the recording sub-circuit 22 through one wire for reducing wiring, thereby simplifying a circuit structure of the gate driving circuit, and reducing fault rate due to complicated wiring. Further, an occupied area of the gate driving circuit is reduced, which is advantageous for realizing a narrow frame of a display device using the gate driving circuit.

In some embodiments, the recording sub-circuit 22 may included an analog-to-digital conversion circuit 220 and a counting circuit 221. The analog-to-digital conversion circuit 220 and the counting circuit 221 are connected to the cathode of the last one of the diodes D connected in series. The analog-to-digital conversion circuit 220 is configured to convert the gate scanning signal in an analog signal form into a digital signal to perform anomaly analysis on the gate scanning signal in the digital signal form. The counting circuit 221 is used to count the number of pulses of the gate scanning signals to quickly determine the position where the gate scanning signal abnormally appears. In some embodiments, the recording sub-circuit 22 may include only one of the analog-to-digital conversion circuit 220 and the counting circuit 221.

In some embodiments, the driver circuit 1 may include n GOA units, each of the GOA units may be connected to a corresponding one of the gate lines 3. In the embodiments shown in FIGS. 2 and 3, the detecting circuit 2 collects and records the gate scanning signal on each of the gate lines 3, respectively, thereby performing an abnormality detection and diagnosis on all the gate scanning signals output by the driving circuit 1.

In some embodiments, the third switch transistor T3 may be connected to a part of the gate lines 3, that is, the detecting circuit 2 may collect and record the gate scanning signals on a part of the gate lines 3, thereby performing an abnormality detection and diagnosis on a part of the gate scanning signals output by the driving circuit 1.

As shown in FIG. 2, in some embodiments, the gate driving circuit may include two groups of the driving circuit 1 and the detecting circuit 2. One group of the driving circuit 1 and the detecting circuit 2 is disposed at one end of the gate lines 3 and connected to the one end of the gate lines 3. The other group of the driving circuit 1 and the detecting circuit 2 is disposed at the other end of the gate lines 3 and connected to the other end of the gate lines 3. By providing two groups of the driving circuit 1 and the detecting circuit 2, on the one hand, the two driving circuits 1 may be capable of driving the gate lines 3 at two ends to ensure smooth output of the gate scanning signals; on the other hand, the two detecting circuits 2 may be capable of detecting the gate scanning signals at both ends of the gate lines 3 together, so that the gate scanning signals on the gate lines 3 can be analyzed and diagnosed for abnormality according to the gate scanning signals at both ends of the gate lines 3, thereby improving the sufficiency and accuracy of the abnormality diagnosis.

Figure 3:
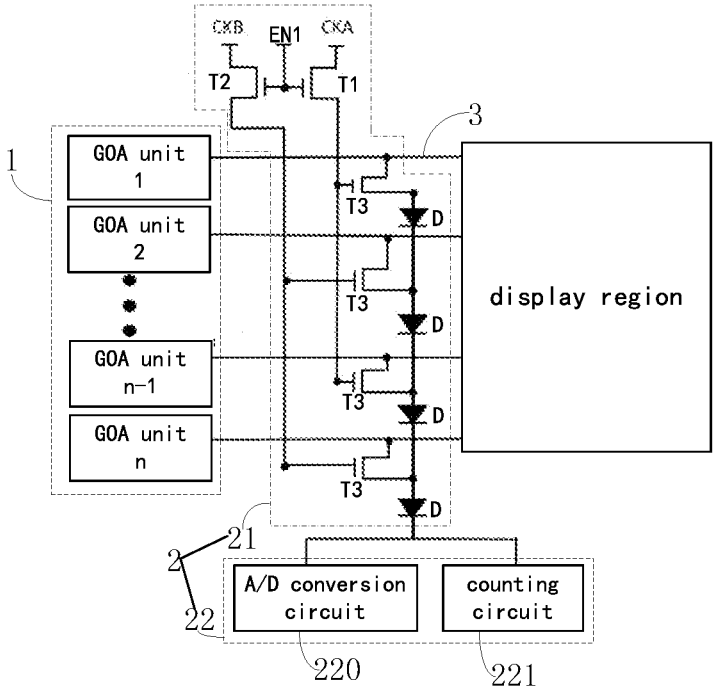
FIG. 3 is a schematic structure diagram illustrating a gate driving circuit according to some embodiments of the present disclosure.

As shown in FIG. 3, in some embodiments, the gate driving circuit may include one group of the driving circuit 1 and the detecting circuit 2 disposed at one end of the gate lines 3 and connected to the one end of the gate lines 3. The driving circuit 1 may be capable of driving the gate lines 3 at the one end. The detecting circuit 2 may be capable of detecting the gate scanning signals on the gate lines 3 for abnormal analysis and diagnosis of the gate scanning signals.

In some embodiments, the first switch transistor T1, the second switch transistor T2, and the third switch transistor T3 may be selected from an NPN transistor or a PNP transistor, respectively. In the embodiments shown in FIGS. 2 and 3, the first switch transistor T1, the second switch transistor T2, and the third switch transistor T3 are NPN transistors.

In some embodiments, the first switch transistor T1, the second switch transistor T2, and the third switch transistor T3 may be PNP transistors. In some embodiments, one of the first switch transistor T1 and the second switch transistor T2 is an NPN transistor and the other is a PNP transistor; and the third switch transistor T3 may be an NPN transistor or a PNP transistor.

Figure 4:
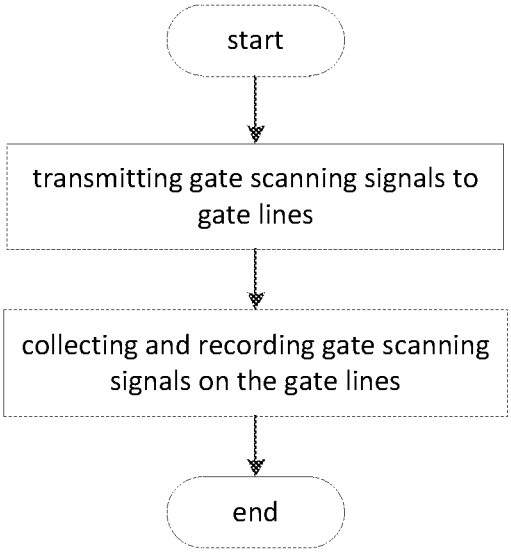
FIG. 4 is a flow chart illustrating a driving method of a gate driving circuit according to some embodiments of the present disclosure.

In another aspect, the present disclosure provides a driving method of the gate driving circuit as described herein. FIG. 4 is a flow chart illustrating a driving method of a gate driving circuit according to some embodiments of the present disclosure.

Referring to FIG. 4, in some embodiments, the method includes: outputting, by a driving circuit, gate scanning signals to gate lines; and collecting and recording, by a detecting circuit, the gate scanning signals on the gate lines.

Figure 5:
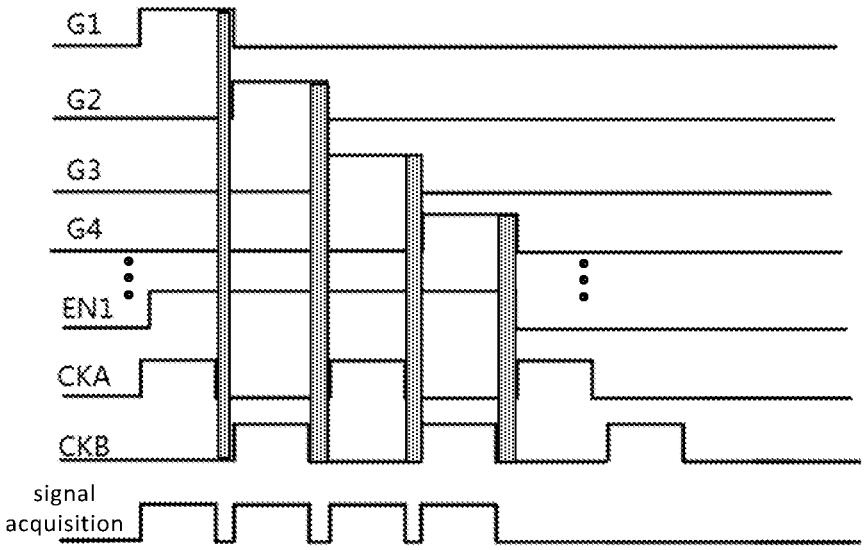
FIG. 5 is a timing diagram illustrating a driving method of a gate driving circuit according to some embodiments of the present disclosure.
Figure 6:
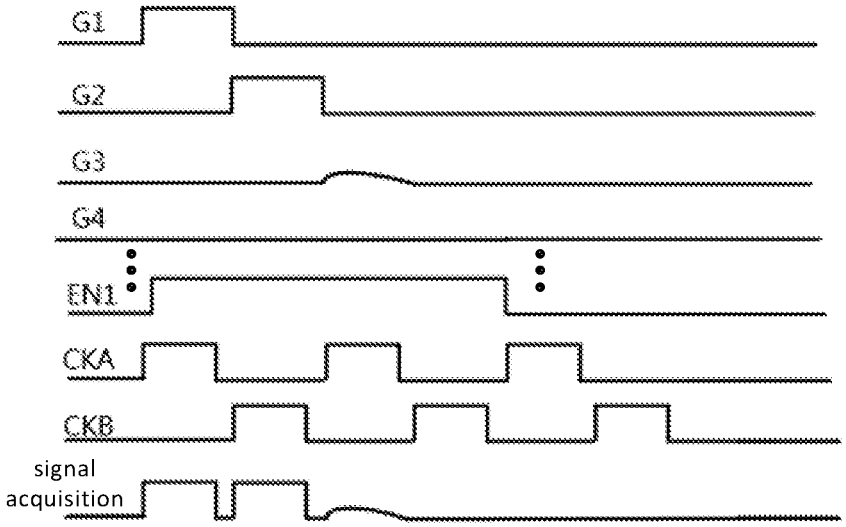
FIG. 6 is a timing diagram illustrating anomalies in the gate scanning signals according to some embodiments of the present disclosure.

FIG. 5 is a timing diagram illustrating a driving method of a gate driving circuit according to some embodiments of the present disclosure, and FIG. 6 is a timing diagram illustrating anomalies in the gate scanning signals according to some embodiments of the present disclosure.

As shown in FIGS. 5 and 6, an enable signal output by the enable signal end EN1 may trigger the first switch transistor T1 and the second switch transistor T2 to be turned on. A first control signal output by the first control signal end CKA may control the third switch transistors T3 connected to the first switch transistor T1 to be turned on, and a second control signal output by the second control signal end CKB may control the third switch transistors T3 connected to the second switch transistor T2 to be turned on. The gate scanning signals G on the gate lines (i.e., the gate scanning signals G1, G2, G3 . . . Gn output from the first to n-th gate lines, respectively) are transmitted to the recording sub-circuit 22 through corresponding third switch transistors T3 connected to the gate lines.

In some embodiments, the first control signal output by the first control signal end CKA and the second control signal output by the second control signal end CKB are square wave signals having a predetermined period, and the first control signal and the second control signal are output in a staggered manner, so that the gate scanning signals G on the gate lines are collected, respectively.

In some embodiments, the driving circuit 1 may drive the gate lines at two ends, one detecting circuit 2 collects and records the gate scanning signals G at one end of the gate lines, and the other detecting circuit 2 collects and records the gate scanning signals G at the other end of the gate lines. In this way, on the one hand, it is capable of driving the gate lines at two ends to ensure smooth output of the gate scanning signals G; on the other hand, it is convenient to detect the gate scanning signals G at both ends of the gate lines together, so that the gate scanning signals G on the gate lines can be analyzed and diagnosed for abnormality according to the gate scanning signals G at both ends of the gate lines, thereby improving the sufficiency and accuracy of the abnormality diagnosis.

In some embodiments, the driving circuit 1 may also drive the gate lines at one end. Accordingly, the detecting circuit 2 collects and records the gate scanning signals G at one end of the gate lines.

In some embodiments, when the driving circuit 1 drives the gate lines at two ends, one detecting circuit 2 and the other detecting circuit 2 simultaneously collect and record the gate scanning signals G at one end and the other end of the gate lines, respectively.

In some embodiments, when the driving circuit drive the gate lines at two ends, one detecting circuit 2 and the other detecting circuit 2 may sequentially collect and record the gate scanning signals at one end and the other end of the gate lines, respectively.

As shown in FIGS. 5 and 6, in some embodiments, the gate scanning signals G on two adjacent gate lines are successively output one by one. The first and second control signals are halted before the gate scanning signals G collected under controls of the first and second control signals are halted, respectively. In this way, it is possible to ensure that the gate scanning signals G collected by the collecting sub-circuit 21 and output after being converted by the analog-to-digital conversion circuit 220 is a square wave waveform signal that can be clearly recognized, thereby facilitating the counting circuit 221 to count the number of square waves in the square wave waveform, and further improving the accuracy of the abnormality diagnosis of the gate scanning signals.

Figure 7:
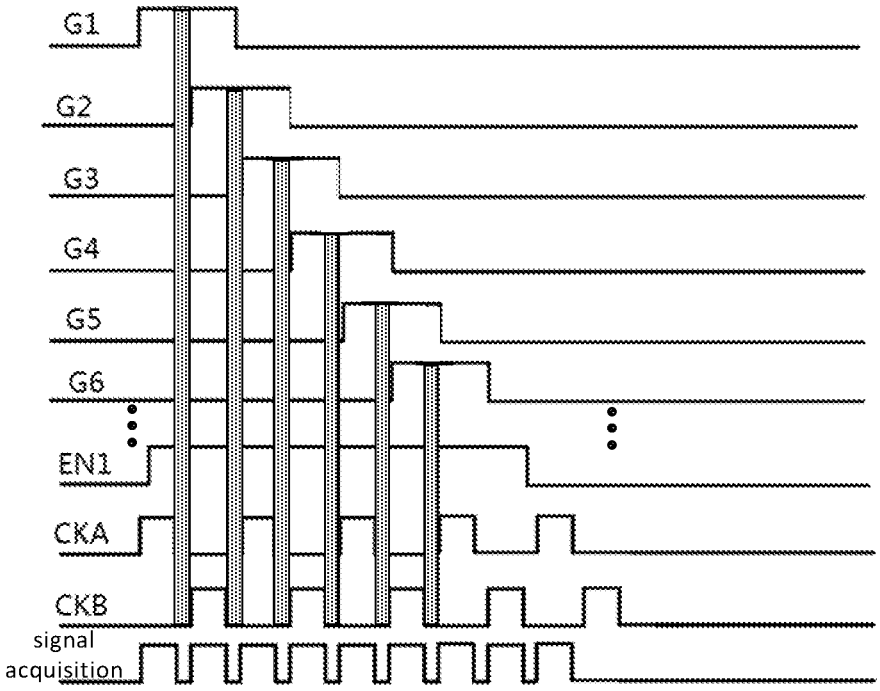
FIG. 7 is a timing diagram illustrating a driving method of a gate driving circuit according to some embodiments of the present disclosure.

FIG. 7 is a timing diagram illustrating a driving method of a gate driving circuit according to some embodiments of the present disclosure.

As shown in FIG. 7, in some embodiments, the gate scanning signals G on two adjacent gate lines may be output partially overlapped. The first and second control signals are halted before the gate scanning signals G collected under controls of the first and second signals are overlapped with each other, respectively. In this way, it is possible to ensure that the gate scanning signals G collected by the collecting sub-circuit 21 and output after being converted by the analog-to-digital conversion circuit 220 is a square wave waveform signal that can be clearly recognized, thereby facilitating the counting circuit 221 to count the number of square waves in the square wave waveform, and further improving the accuracy of the abnormality diagnosis of the gate scanning signals.

Figure 8:
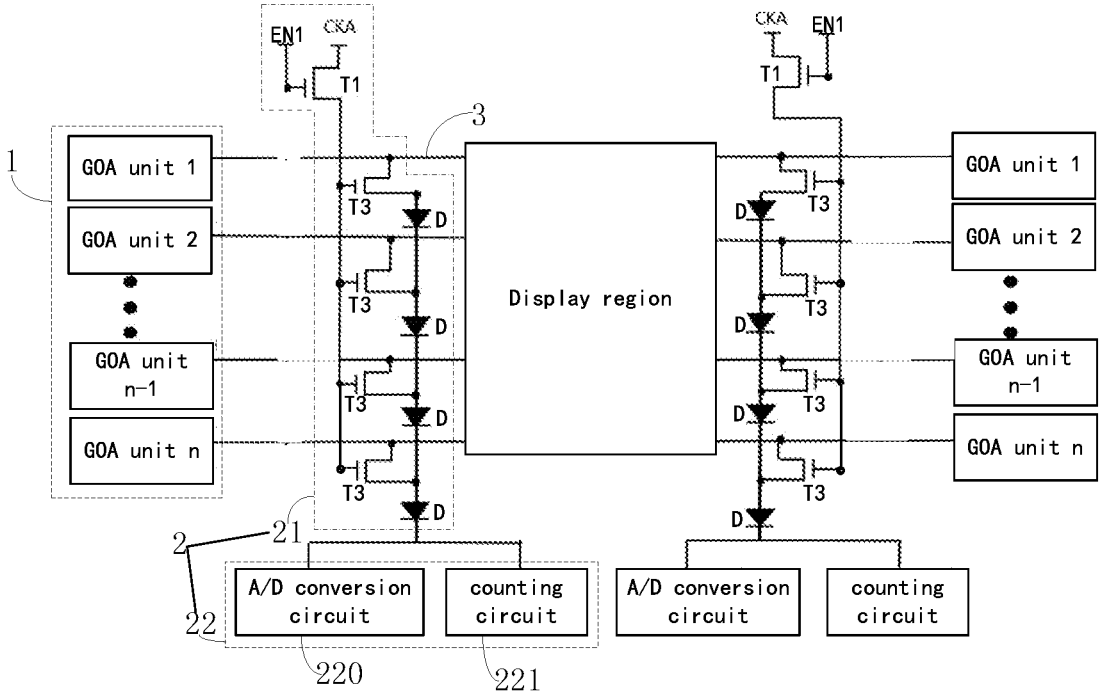
FIG. 8 is another schematic structure diagram illustrating a gate driving circuit according to some embodiments of the present disclosure.

FIG. 8 is another schematic structure diagram illustrating a gate driving circuit according to some embodiments of the present disclosure.

As shown in FIG. 8, in some embodiments, the collecting sub-circuit 21 includes a first switch transistor T1 and a plurality of third switch transistors T3. Each of the plurality of third switch transistors T3 is connected to a corresponding one of the gate lines 3. A gate electrode of the first switch T1 is connected to an enable signal end EN1, a first electrode of the first switch transistor T1 is connected to a first control signal end CKA, and a second electrode of the first switch transistor T1 is connected to gate electrodes of the third switch transistors T3. Each of first electrodes of the third switch transistors T3 is connected to a corresponding one of the gate lines 3, and second electrodes of all of the third switch transistors T3 are electrically connected to the recording sub-circuit 22.

In some embodiments, the first switch transistor T1 and the third switch transistor T3 are NPN transistors.

In some embodiments, the first switch transistor T1 and the third switch transistor T3 may be PNP transistors. In some embodiments, one of the first switch transistor T1 and the third switch transistor T3 is an NPN transistor and the other is a PNP transistor.

In addition, other circuit configurations of the collecting sub-circuit 21 and other circuit configurations of the gate driving circuit shown in FIG. 8 are the same as those shown in FIG. 2, and are not described herein again.

Figure 9:
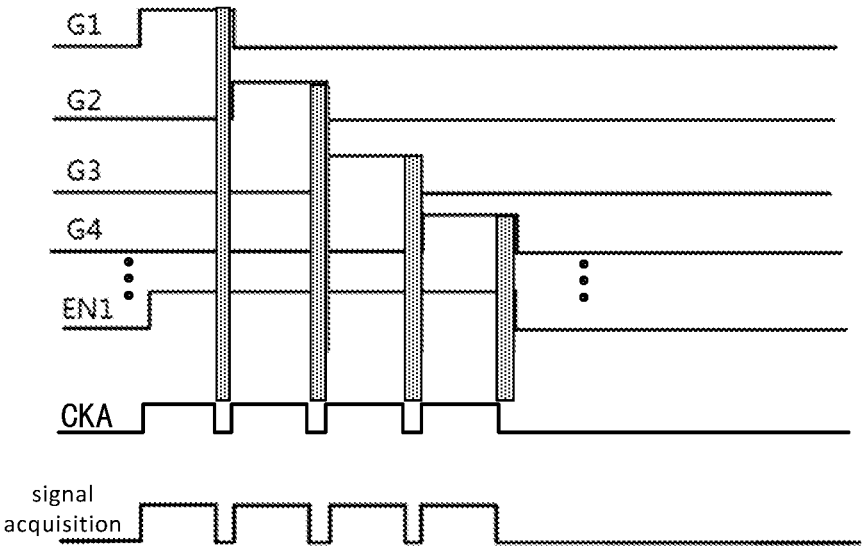
FIG. 9 is a timing diagram illustrating a driving method of a gate driving circuit according to some embodiments of the present disclosure.

FIG. 9 is a timing diagram illustrating a driving method of a gate driving circuit according to some embodiments of the present disclosure.

As shown in FIG. 9, in some embodiments, an enable signal output by the enable signal end EN1 may trigger the first switch transistor T1 to be turned on, and a first control signal output by the first control signal end CKA may control the third switch transistors T3 connected to the first switch transistor T1 to be turned on. The gate scanning signals G on the gate lines (i.e., the gate scanning signals G1, G2, G3 . . . Gn output from the first to n-th gate lines, respectively) are transmitted to the recording sub-circuit 22 through corresponding third switch transistors T3 connected to the gate lines.

In some embodiments, the first control signal output by the first control signal end CKA is a square wave signal having a predetermined period, and the first control signal controls the gate scanning signals G on the gate lines to be collected, respectively.

As shown in FIG. 9, in some embodiments, the gate scanning signals G on two adjacent gate lines are successively output one by one, and the first control signal is halted before the gate scanning signals G collected under a control of the first control signal are halted. In this way, it is possible to ensure that the gate scanning signals G collected by the collecting sub-circuit 21 and output after being converted by the analog-to-digital conversion circuit 220 is a square wave waveform signal that can be clearly recognized, thereby facilitating the counting circuit 221 to count the number of square waves in the square wave waveform, and further improving the accuracy of the abnormality diagnosis of the gate scanning signals.

Figure 10:
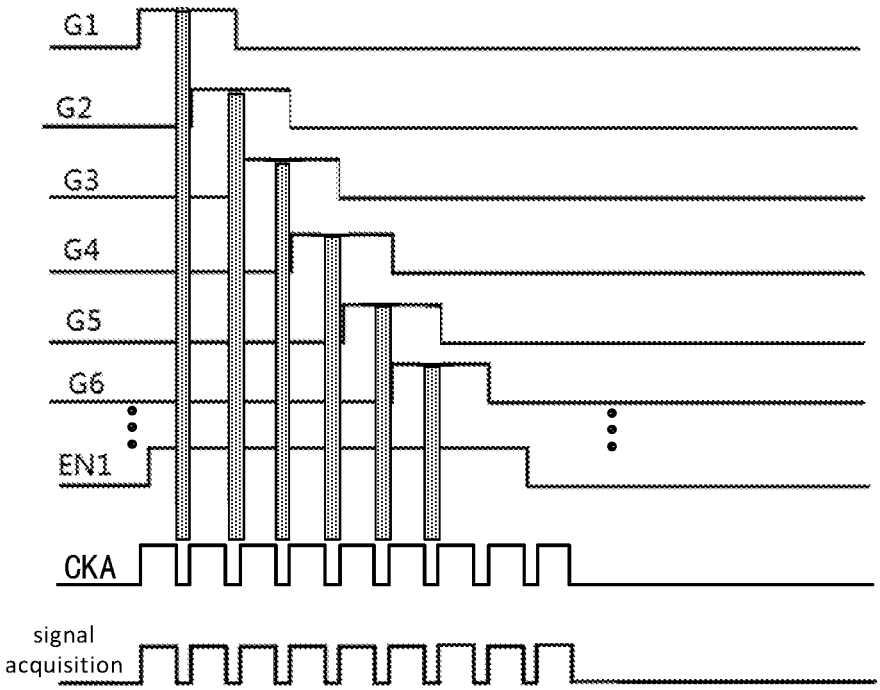
FIG. 10 is a timing diagram illustrating a driving method of a gate driving circuit according to some embodiments of the present disclosure.

FIG. 10 is a timing diagram illustrating a driving method of a gate driving circuit according to some embodiments of the present disclosure.

As shown in FIG. 10, in some embodiments, the gate scanning signals G on two adjacent gate lines may be output partially overlapped. The first control signal is halted before the gate scanning signals G collected under a control of the first control signal are overlapped with each other. In this way, it is possible to ensure that the gate scanning signals G collected by the collecting sub-circuit 21 and output after being converted by the analog-to-digital conversion circuit 220 is a square wave waveform signal that can be clearly recognized, thereby facilitating the counting circuit 221 to count the number of square waves in the square wave waveform, and further improving the accuracy of the abnormality diagnosis of the gate scanning signals.

In another aspect, the present disclosure provides a display device including the gate driving circuit described herein.

In some embodiments, the display device may be any product or component having a display function, such as an OLED panel, an OLED television, an LCD panel, an LCD television, a display, a cell phone, a navigator, and the like.

It is to be understood that the above description is only for the purpose of illustrating the principles of the present disclosure, but the disclosure is not limited thereto. Various modifications and improvements can be made by those skilled in the art without departing from the spirit and scope of the disclosure, and such modifications and improvements are also considered to be within the scope of the disclosure.

What is claimed is:

1. A gate driving circuit, comprising:

a driving circuit connected to a plurality of gate lines and configured to output gate scanning signals; and a detecting circuit connected to the gate lines and configured to collect and record the gate scanning signal, wherein the detecting circuit comprises a collecting sub-circuit and a recording sub-circuit, the collecting sub-circuit is connected to the gate lines and the recording sub-circuit and configured to transmit the gate scanning signals collected from the gate lines to the recording sub-circuit, and the recording sub-circuit is configured to record the gate scanning signal and comprises at least one of an analog-to-digital conversion circuit and a counting circuit.

2. The gate driving circuit of claim 1, wherein the collecting sub-circuit comprises a first switch transistor and a plurality of third switch transistors, each of the plurality of third switch transistors is connected to a corresponding one of the gate lines, a gate electrode of the first switch transistor is connected to an enable signal end, a first electrode of the first switch transistor is connected to a first control signal end, and a second electrode of the first switch transistor is connected to gate electrodes of the plurality of third switch transistors, and each of first electrodes of the plurality of third switch transistors is connected to a corresponding one of the gate lines, and second electrodes of the plurality of third switch transistors are connected to the recording sub-circuit.

3. The gate driving circuit of claim 2, wherein the collecting sub-circuit further comprise a second switch transistor, the gate electrode of the first switch transistor and a gate electrode of the second switch transistor are connected to the enable signal end, the first electrode of the first switch transistor is connected to the first control signal end, and the second electrode of the first switch transistor is connected to gate electrodes of a part of the plurality of third switch transistors, a first electrode of the second switch transistor is connected to a second control signal end, a second electrode of the second switch transistor is connected to gate electrodes of a remaining part of the plurality of third switch transistors, and the gate lines corresponding to the third switch transistors connected to the first switch transistor and the gate lines corresponding to the third switch transistors connected to the second switch transistor are alternately arranged with each other.

4. The gate driving circuit of claim 2, wherein the collecting sub-circuit further comprise a plurality of diodes, each of the plurality of third switch transistors is connected to a corresponding one of the plurality of diodes, and the plurality of diodes are connected in series, and each of the second electrodes of the plurality of third switch transistors is connected to an anode of the corresponding one of the plurality of diodes, and a cathode of the last one of the plurality of diodes connected in series is connected to the recording sub-circuit.

5. The gate driving circuit of claim 4, wherein the analog-to-digital conversion circuit and the counting circuit are connected to the cathode of the last one of the plurality of diodes connected in series, the analog-to-digital conversion circuit is configured to convert the gate scanning signal into a digital signal, and the counting circuit is configured to count the number of pulses of the gate scanning signals.

6. The gate driving circuit of claim 1, wherein the driving circuit comprises a plurality of gate driving circuit units connected to the gate lines, respectively.

7. The gate driving circuit of claim 1, wherein the gate driving circuit comprises a first group of the driving circuit and the detecting circuit disposed at and connected to a first end of the gate lines.

8. The gate driving circuit of claim 7, wherein the gate driving circuit further comprise a second group of the driving circuit and the detecting circuit disposed at and connected to a second end of the gate lines.

9. A display device comprising the gate driving circuit of claim 1.

10. A driving method of a gate driving circuit comprising a driving circuit and a detecting circuit, the method comprising:

outputting, by the driving circuit, gate scanning signals to a plurality of gate lines; and collecting and recording, by the detecting circuit, the gate scanning signals on the gate lines, wherein the detecting circuit comprises a collecting sub-circuit and a recording sub-circuit, the collecting sub-circuit is connected to the gate lines and the recording sub-circuit, the collecting sub-circuit comprises a first switch transistor and a plurality of third switch transistors, each of the plurality of third switch transistors is connected to a corresponding one of the gate lines, a gate electrode of the first switch transistor is connected to an enable signal end, a first electrode of the first switch transistor is connected to a first control signal end, and a second electrode of the first switch transistor is connected to gate electrodes of the plurality of third switch transistors, each of first electrodes of the plurality of third switch transistors is connected to a corresponding one of the gate lines, and second electrodes of the plurality of third switch transistors are connected to the recording sub-circuit, and the driving method further comprises:

turning on, by an enable signal, the first switch transistor;

turning on, by a first control signal, the third switch transistors connected to the first switch transistor; and transmitting, by the third switch transistors connected to the gate lines, the gate scanning signals on the gate lines to the recording sub-circuit.

11. The driving method of claim 10, wherein the collecting sub-circuit further comprise a second switch transistor, the gate electrode of the first switch transistor and a gate electrode of the second switch transistor are connected to the enable signal end, the first electrode of the first switch transistor is connected to the first control signal end, the second electrode of the first switch transistor is connected to gate electrodes of a part of the plurality of third switch transistors, a first electrode of the second switch transistor is connected to a second control signal end, and a second electrode of the second switch transistor is connected to gate electrodes of a remaining part of the plurality of third switch transistors, the gate lines corresponding to the third switch transistors connected to the first switch transistor and the gate lines corresponding to the third switch transistors connected to the second switch transistor are alternately arranged with each other, and the driving method further comprises:

turning on, by the enable signal, at least one of the first switch transistor and the second switch transistor;

turning on, by the first control signal, the third switch transistors connected to the first switch transistor;

turning on, by a second control signal, the third switch transistors connected to the second switch transistor; and transmitting, by the third switch transistors connected to the gate lines, the gate scanning signals on the gate lines to the recording sub-circuit.

12. The driving method of claim 11, wherein the gate scanning signals on two adjacent gate lines are output successively, the first control signal is halted before the gate scanning signals collected under a control of the first control signal are halted, and the second control signal is halted before the gate scanning signals collected under a control of the second control signal are halted.

13. The driving method of claim 11, wherein the gate scanning signals on two adjacent gate lines are output partially overlapped, and the first control signal and the second control signal are halted before the gate scanning signals collected respectively under controls of the first control signal and the second control signal are overlapped with each other.

14. The driving method of claim 10, wherein the gate driving circuit comprises a first group of the driving circuit and the detecting circuit disposed at and connected to a first end of the gate lines, and the driving method further comprises:

driving, by the driving circuit in the first group, the gate lines at the first end; and collecting and recording, by the detecting circuit of the first group, the gate scanning signals at the first end of the gate lines.

15. The driving method of claim 14, wherein the gate driving circuit further comprise a second group of the driving circuit and the detecting circuit disposed at and connected to a second end of the gate lines, and the driving method further comprises:

driving, by the driving circuits of the first and second groups, the gate lines at the first and second ends;

collecting and recording, by the detecting circuits of the first and second groups, the gate scanning signals at the first and second ends of the gate lines, respectively.

16. The driving method of claim 15, wherein the gate scanning signals at the first and second ends of the gate lines are collected and recorded simultaneously or sequentially by the detecting circuits of the first and second groups.

17. The driving method of claim 10, wherein the gate scanning signals on two adjacent gate lines are output successively, and the first control signal is halted before the gate scanning signals collected under a control of the first control signal are halted.

18. The driving method of claim 10, wherein the gate scanning signals on two adjacent gate lines are output partially overlapped, and the first control signal is halted before the gate scanning signals collected under a control of the first control signal are overlapped with each other.

* * * * *